US009738353B2

(12) United States Patent
Richardson

(10) Patent No.: US 9,738,353 B2
(45) Date of Patent: Aug. 22, 2017

(54) BUOY MARKER WITH DEPLOYING ANCHOR

(71) Applicant: Matthew Richardson, Nokomis, FL (US)

(72) Inventor: Matthew Richardson, Nokomis, FL (US)

( * ) Notice: Subject to any disclaimer, the term of this patent is extended or adjusted under 35 U.S.C. 154(b) by 0 days.

(21) Appl. No.: 14/991,515

(22) Filed: Jan. 8, 2016

(65) Prior Publication Data

US 2016/0200400 A1 Jul. 14, 2016

Related U.S. Application Data

(60) Provisional application No. 62/101,614, filed on Jan. 9, 2015.

(51) Int. Cl.

| | |
|---|---|
| ***B63B 22/00*** | (2006.01) |
| ***B63B 22/16*** | (2006.01) |
| *B63C 7/26* | (2006.01) |
| *B63B 21/22* | (2006.01) |
| *B63B 21/26* | (2006.01) |

(52) U.S. Cl.

CPC ..... *B63B 22/16* (2013.01); *B63B 2021/225* (2013.01); *B63B 2021/265* (2013.01); *B63B 2201/00* (2013.01); *B63B 2205/06* (2013.01); *B63C 7/26* (2013.01)

(58) Field of Classification Search

CPC ..... B63B 22/16; B63B 22/00; B63B 22/18; B63B 2205/06; B63B 2201/20; B63B 22/08; B63B 2205/04; B63B 2201/00

USPC ..... 441/6–10

See application file for complete search history.

(56) References Cited

U.S. PATENT DOCUMENTS

| | | | | |
|---|---|---|---|---|
| 1,385,457 | A * | 7/1921 | Kiest | A01K 97/16 242/303 |
| 2,722,019 | A | 11/1955 | Brock | |
| 2,903,716 | A | 9/1959 | Zasada | |
| 2,944,267 | A * | 7/1960 | Kurtz | B63B 22/20 441/25 |
| 2,957,446 | A | 10/1960 | Zasada | |
| 3,005,215 | A | 10/1961 | Colt et al. | |
| 3,089,156 | A | 5/1963 | Hamm | |
| 3,196,469 | A | 7/1965 | Anthony | |
| 3,487,485 | A | 1/1970 | Holm et al. | |
| 3,597,778 | A | 8/1971 | Castelliz | |
| 3,618,150 | A | 11/1971 | Anselmi | |
| 3,631,550 | A | 1/1972 | Bullen | |
| 4,781,636 | A * | 11/1988 | Schurr | B63B 22/18 242/395 |
| 8,047,461 | B1 * | 11/2011 | Slawson | A01K 89/003 242/227 |

* cited by examiner

*Primary Examiner* — Andrew Polay
(74) *Attorney, Agent, or Firm* — Dinsmore & Stohl LLP

(57) ABSTRACT

A marker buoy constructed of a main shaft extending vertically when in use and including a marker flag, a floating body, and a spool mounted to the main shaft.

6 Claims, 3 Drawing Sheets

BUOY MARKER WITH DEPLOYING ANCHOR

CROSS-REFERENCE TO RELATED APPLICATIONS

This application claims priority of U.S. Provisional Patent Application Ser. No. 62/101,614, filed Jan. 9, 2015, which is incorporated herein by reference.

FIELD OF THE INVENTION

The present invention relates to a marker buoy having a self-deploying anchor and more particularly to an easily constructed and assembled marker buoy.

BACKGROUND OF THE INVENTION

Marker buoys are currently known and used. Marker buoys may serve as a warning for marine vessels to steer clear of a particular area. For instance, marker buoys are known to have flags which may indicate the presence of a diver so as to deter a marine vessel from approaching the area and interfering with the ascent of a diver. They are also used to mark fishing locations after a fishing area has been found so that the fisherman can return to a fishing location where he has been successful.

Marker buoys are known which include an anchor. The anchors are connected to the buoy via a line which may be wound onto a spool. The spools are generally cylindrical in plan view so as to wind the line in a circumferential manner. The weight of the anchor unravels the line from the spool. The spool may be exposed to the currents when the marker buoy is deployed, or may be contained within a housing.

In another embodiment of a prior art marker buoy having a self-deploying anchor the buoy includes a handle mechanically attached to the spool so as to permit cranking of the spool and bring up the anchor. The spool is mechanically attached to a gear mechanism configured to allow the spool to freely rotate in one direction so as to allow for the deployment of the anchor via gravity when the handle is released.

However, heretofore buoys with self-deploying anchors have been constructed such that the line may become tangled during the deployment as a result of the water currents and surface waves. Accordingly, it remains desirable to have a marker buoy having a self-deploying anchor wherein the line is held in a position to facilitate the free deployment of the anchor without having the line becoming tangled due to the effects of current and waves. Further it remains desirable to have a portable marker buoy with a self-deploying anchor which may be easily retrieved without the use of a hand operated crank handle.

Also such marker buoys of the prior art are unduly complicated in their construction and assembly.

SUMMARY OF THE INVENTION

A marker buoy having a self-deploying anchor is provided. The anchor is attached to a spool. The spool includes a plurality of spaced apart arms, the distal ends of which include a cut away portion to form a slot. The slots in the arms receive the line so as to wind the line onto the spool upon rotation of the spool. The spool feeds a line through a guide to the anchor. A clicker is provided to provide resistance to rotation of the spool and thus retains the line in a taut condition as the line unwinds.

A drive connector preferably in the form of a nut or a socket is disposed on an exposed surface at the hub of the spool. The nut or socket may be engaged by a power wrench or other battery driven power tool, such as a drill motor or the like to bring up the line when the marker buoy is ready to be stowed.

The buoy is preferably constructed of a main shaft which extends substantially vertically when the buoy is in use. A flag or other marker is mounted to upper portion of the shaft. A floating body is mounted to the shaft below the flag. The spool is mounted to the main shaft below the floating body and a guide for the line is formed to extend to the main shaft below the spool.

DETAILED DESCRIPTION OF THE INVENTION

Figure 1:
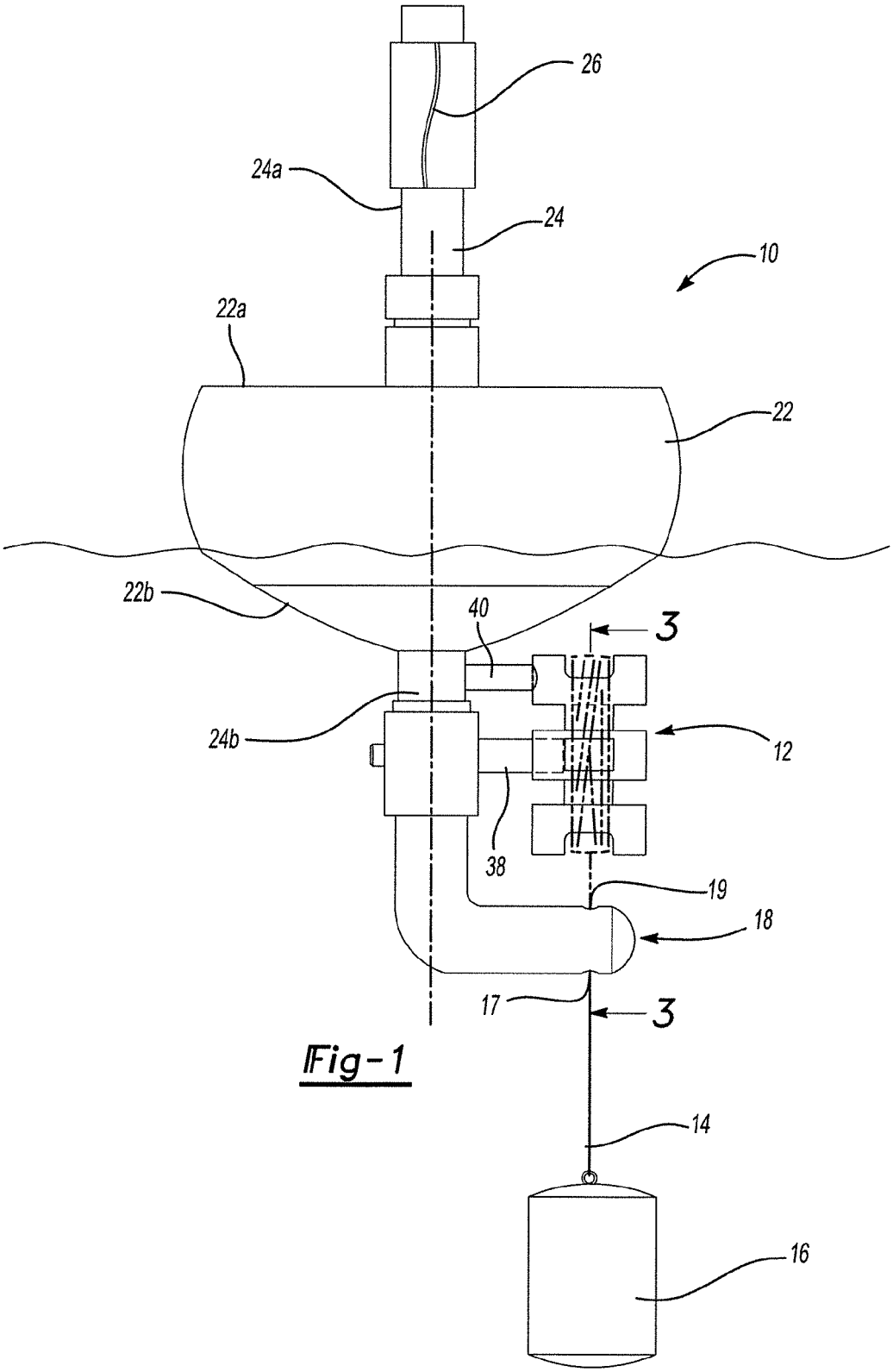
FIG. 1 is a side elevational view of the marker buoy of the present invention.
Figure 2:
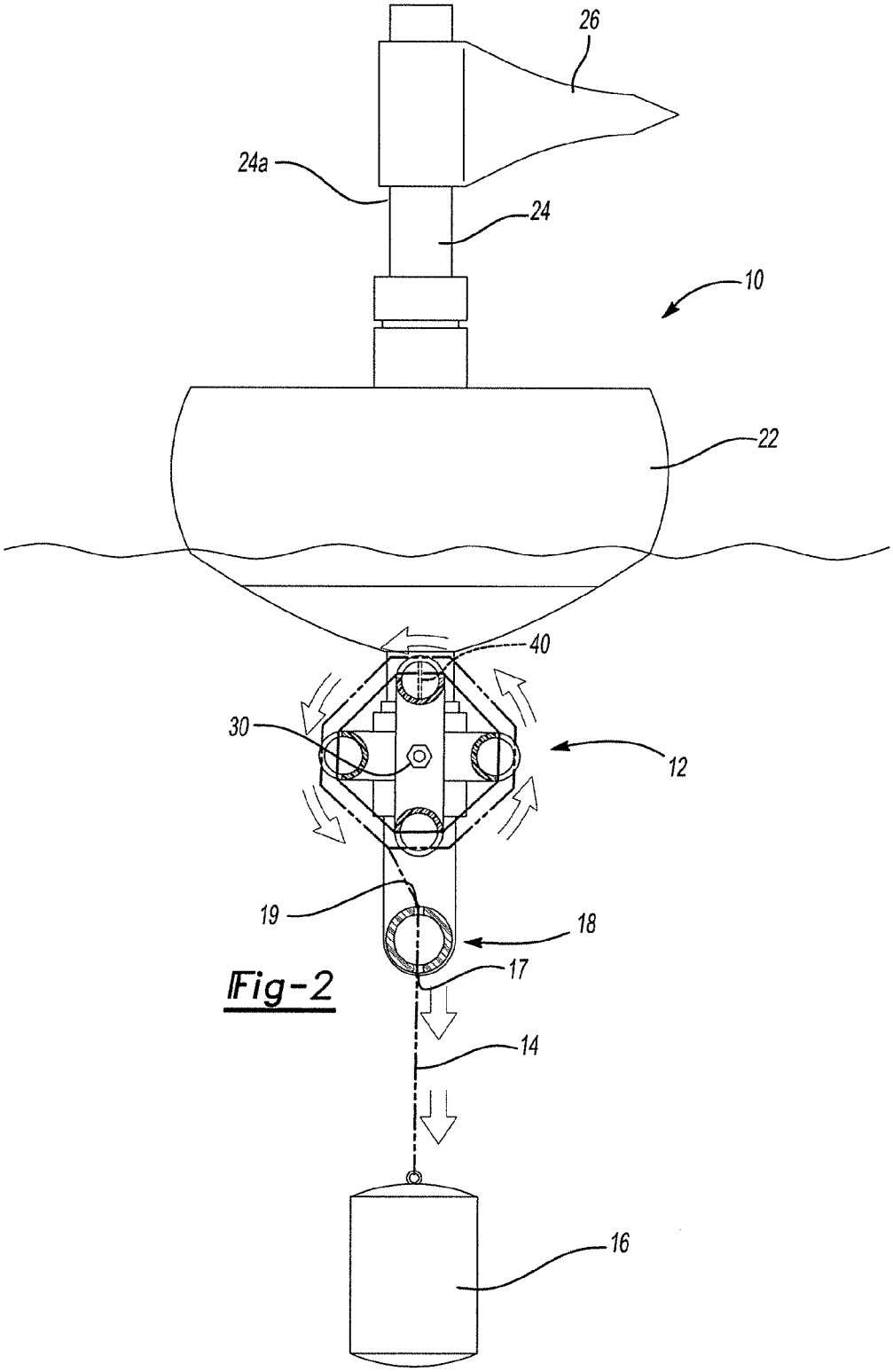
FIG. 2 is an elevational view of the marker buoy rotated 90 degrees about the vertical axis from the view shown in FIG. 1.
Figure 3:
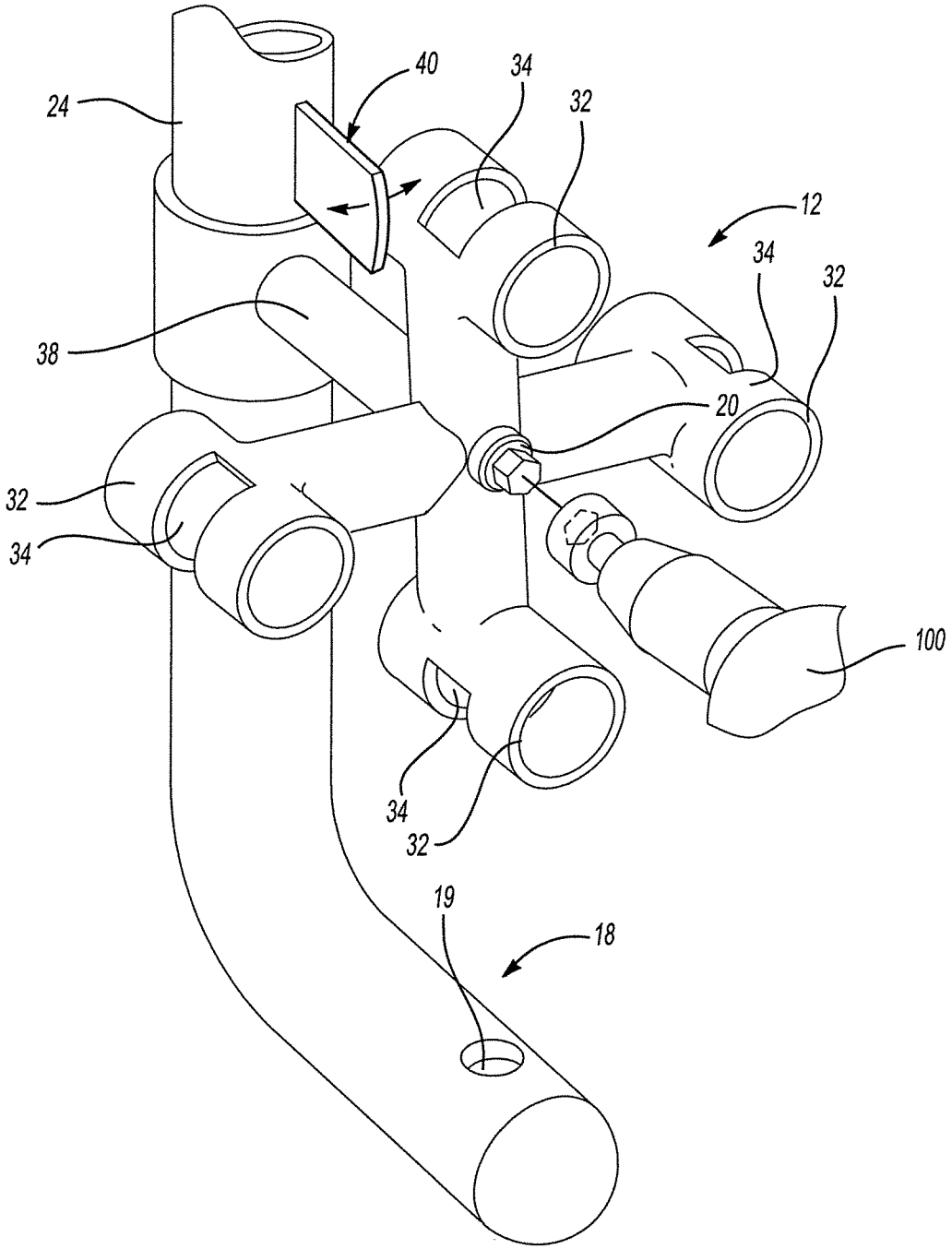
FIG. 3 is a fragmentary enlarged perspective view of the marker buoy taken substantially at line 3-3 of FIG. 1.

As a best seen in FIGS. 1 and 2 a marker buoy 10 is shown as having a rotatable spool 12 configured to hold a line 14 attached to an anchor 16. The marker buoy 10 includes a guide 18 for controlling the movement of the line 14 to which the anchor 16 is attached so as to help ensure the proper deployment of the anchor 16. The marker buoy 10 further includes a drive connection 20 fixedly mounted to the hub 21 of spool 12. The drive connection 20 can be in the form of a socket or a nut as will become apparent as the description proceeds. As best seen in FIG. 3 the drive connection 20 can be configured to engage a power wrench, a battery driven drill, or the like 100 so as to facilitate the rapid winding of the line 14 on the spool 20 and retrieval of the anchor 16.

With reference again to FIGS. 1 and 2, an illustrative view of the marker buoy 10 is provided. The marker buoy 10 includes a floating body 22, a main shaft 24, the guide 18, the spool 12, the line 14, and the anchor 16. The floating body 22 includes a top surface 22*a* and a bottom surface 22*b*.

The main shaft 24 is an elongated body a portion of which extends generally through the center mass of the floating body 22. The floating body 22 may be formed of a rubber or foam having a density less than that of water so as to support a top portion 24*a* of the main shaft 24 above the water. The shaft 24 extends substantially vertical when the buoy 10 is in a position of use.

A flag 26 may be mounted to the top portion 24*a* of the main shaft 24. The flag 26 may include indicia to provide notice to maritime vessels of a hazard or an activity for which the maritime vessel should avoid. Such indicia may include a maritime signal for diving, salvaging, or a hidden danger under the surface of the water. The indicia may be a flag 26 which is simply to locate a favorite fishing spot.

A lower portion 24*b* of the main shaft 24 extends beneath the bottom surface 22*b* of the floating body 22. The spool 12 is attached to the lower portion of the main shaft 24 and is freely rotatable thereon. The guide 18 extends generally orthogonally from a distal end of the lower portion 24*b* of the main shaft 24 and includes openings 17 and 19 aligned with the line 14 from the spool 12 and with the line 14 extending through the openings 17 and 19 to be attached to the anchor 16.

The main shaft 24 may be formed of a generally resilient and rigid material such as plastic. Plastics are commonly known and used in the art and any form of plastic may be adapted for use herein to include plastic tubing commonly referenced as PVC tubing As is clear from the drawings PVC tubing or the like can be used to construct the spool 12 as well As best seen in FIG. 3 the spool 12 is mounted above the guide holes 17 and 19. A center of the spool 12, i.e. the pivot point 30 in FIG. 2, is axially aligned above a guide holes 17 and 19 disposed along a distal end of the guide 18.

The use of available PVC tubing to construct the main shaft 24, the spool 12, and the guide 18 contributes to the ease of construction of the marker buoy 10 of the present invention. Attaching the flag 26, the floating body 22, and the spool 12 to the main shaft 24 provides a marker buoy 10 that can be easily assembled The spool 12 is formed of four arms 32 which are angled evenly away from each other in 360 degrees. Each arm 32 is a generally elongated tubing member, the longitudinal axis of which is generally parallel to each other. Each arm 32 has a pair of removed portions disposed near the end of the arm. The removed portions are spaced apart from each other so as to form a series of slots 34 for receiving the line 14 to be wound within.

As can best be seen in FIGS. 1 and 3 a driveshaft 38 is mounted to the pivot point 30 and is generally fixed to the center mass of where the arms 32 meet. The driveshaft 38 is configured to spin freely within an opening of the lower end 24*b* of the main shaft 24. The driveshaft 38 may include an end portion serving as a drive connector 20 for engaging a device such as power wrench or battery driven drill motor 100 to rotate the spinning driveshaft 38

One end of the driveshaft 38 projects outwardly from pivot point 30 and includes the drive connector 20 which may be engaged by a power wrench or a battery driven drill motor 100 as shown in FIG. 3. However, it should be appreciated that the drive connector 20 may also be on the opposite end of the driveshaft 38, relative to the spool 12. As shown in FIG. 3, the drive connector 20 may be a nut 20. It could be a socket as well. It should further be appreciated by those skilled in the art that the nut 20 may be engaged by a power wrench 100. It should be obvious that instead of a nut 20 the drive connector could take other forms to be rotated by other means such as a drill motor or the like.

As best seen in FIG. 1 a clicker 40 is disposed above the driveshaft 38. The clicker 40 extends generally orthogonally from the lower end 24*b* of the main shaft 24 between the bottom surface 22*b* of the floating body 22 and the driveshaft 38. The clicker 40 extends partially into the space between the spool arm 32 so as to engage the spool arms 32 as the spool 12 is rotating to provide resistance to rotation of the spool 12 Enough resistance is provided by the clicker 40 to stop rotation of the spool 12 when the anchor 16 has reached the bottom of the water to keep the line taut and the marker 10 properly positioned over the anchor. This is especially important when a fisherman is using the marker to mark a fishing spot that the fisherman wants to return to.

As best seen in FIG. 3 the clicker 40 is in the form of a rectangular piece preferably of plastic material attached to and extending outwardly from the main shaft 24 into the path of rotation of the arms 32 to provide resistance to the rotation of the spool 12. The clicker 40 is formed of sufficiently flexible material that it will engage the arms as they rotate but will bend to permit the passage of the arms 32.

With reference again to FIGS. 1 and 3, the guide 18 is disposed at a distal end of the lower end 24*b* of the main shaft 24. The guide 18 may be integrally formed and is generally an elongated member orthogonal to the lower end of the main shaft 24 so as to form an elbow. The guide holes 17 and 19 extend through opposite top and bottom surfaces of the guide 18. The line 14 extends from the spool 12 through the guide holes 17 and 19 of the guide 18 to the anchor 16. Thus, upon release of the buoy 10 the anchor 16 which is attached to a distal end of the line 14 is free to drop, pulling taut the line 14 rotating the spool 12 wherein the guide holes 17-19 help guide 18 the line 14 and prevent the line 14 within the spool 12 from being tangled. The clicker 40 aids in keeping the line 14 taut as it is lowered and once the anchor 16 is in place.

A marker buoy has been provided which can be formed of easily obtainable and relative inexpensive materials primarily PVC tubing and which can be easily and readily assembled. The main shaft 24 provides the support for the floating body 22, the spool 12, the line guide 18 and the flag 26.

It should be appreciated that changes, modifications, and the like can be made by those skilled in the art and still fall within the scope of the present invention.

I claim:

1. A marker buoy comprising:

a) a vertical shaft having an upper end and a lower end;

b) a marker mounted to said upper end of said shaft said shaft and a spool mounted to said lower end of said shaft;

c) a line mounted to said spool and an anchor attached to the end of said line;

d) a buoy body mounted to said shaft intermediate said marker and said spool;

e) said spool comprising a plurality of arcuately spaced spool arms with slot formed in the end of each arm, and f) said line being wound around and positioned within said slots formed in said arms, and g) said vertical shaft and said arms being formed of PVC tubing.

2. A marker buoy comprising:

a) a vertical shaft having an upper end and a lower end;

b) a marker mounted to said upper end of said shaft said shaft and a spool mounted to said lower end of said shaft;

c) a line mounted to said spool and an anchor attached to the end of said line;

d) a buoy body mounted to said shaft intermediate said marker and said spool;

e) said spool comprising a plurality of arcuately spaced spool arms with slot formed in the end of each arm, and f) said line being wound around and positioned within said slots formed in said arms, and g) said shaft and said spool being formed of plastic tubing.

3. The marker buoy as defined in claim 2 and including a clicker mounted to said shaft and extending between said spool arms to resist rotation of said spool.

4. The marker buoy as defined in claim 2 and a driver connector mounted to said spool to receive means for rotating said spool to wind up said line.

5. The marker buoy as defined in claim 2 in which said marker is a flag.

6. The marker buoy as defined in claim 2 and including a guide formed in the lower end of said shaft to center the line from said spool.

* * * * *